US006652352B1

(12) United States Patent
MacArthur et al.

(10) Patent No.: US 6,652,352 B1
(45) Date of Patent: Nov. 25, 2003

(54) ROBOTIC TOY

(76) Inventors: William C. MacArthur, 7280 Bethel Hills Dr., Saline, MI (US) 48176; Michael S. Campbell, 2942 Verle Ave., Ann Arbor, MI (US) 48108; James C. Barnes, 2890 Butternut St., Ann Arbor, MI (US) 48108; James A. Campbell, 7136 Plymouth Rd., Ann Arbor, MI (US) 48105

( * ) Notice: Subject to any disclaimer, the term of this patent is extended or adjusted under 35 U.S.C. 154(b) by 0 days.

(21) Appl. No.: 09/781,819

(22) Filed: Feb. 12, 2001

Related U.S. Application Data

(60) Provisional application No. 60/181,487, filed on Feb. 10, 2000.

(51) Int. Cl.[7] ..... A63H 7/00

(52) U.S. Cl. ..... 446/356; 446/353; 446/377; 446/456; 446/457; 446/368; 180/8.6

(58) Field of Search ..... 446/368, 377, 446/390, 308, 355, 352, 454, 356, 353, 330, 456, 457; 901/8, 31, 50; 414/915

(56) References Cited

U.S. PATENT DOCUMENTS

| | | | | | |
|---|---|---|---|---|---|
| 2,827,735 | A | * | 3/1958 | Grimm, Jr. | 46/150 |
| 2,918,738 | A | * | 12/1959 | Barr | 37/80 |
| 3,331,463 | A | * | 7/1967 | Kramer | 180/8 |
| 4,629,440 | A | * | 12/1986 | McKittrick, Jr. et al. | 446/356 |
| 5,423,708 | A | * | 6/1995 | Allen | 446/356 |
| 5,993,286 | A | * | 11/1999 | Tacquard et al. | 446/351 |
| 6,238,264 | B1 | * | 5/2001 | Kazami et al. | 446/356 |
| 6,290,567 | B1 | * | 9/2001 | Chiu | 446/356 |

* cited by examiner

*Primary Examiner*—Derris H. Banks
*Assistant Examiner*—Ali Abdelwahed
(74) *Attorney, Agent, or Firm*—Lynn E. Cargill

(57) ABSTRACT

A radio controlled robotic toy having a main body chassis with at least two middle legs and at least two corner legs attached to the chassis, the legs being interconnected and driven by a linkage drive arm which is, in turn, operated by a radio-controlled electric motor which has computer electronics and software to control and cause movement of the legs for propelling the toy forward and backward. A six-legged walking animatronic robot toy is one of the preferred embodiments, including a moving head with jaw pincers, six moving legs, which yields a versatile, durable, speedy robot toy.

20 Claims, 7 Drawing Sheets

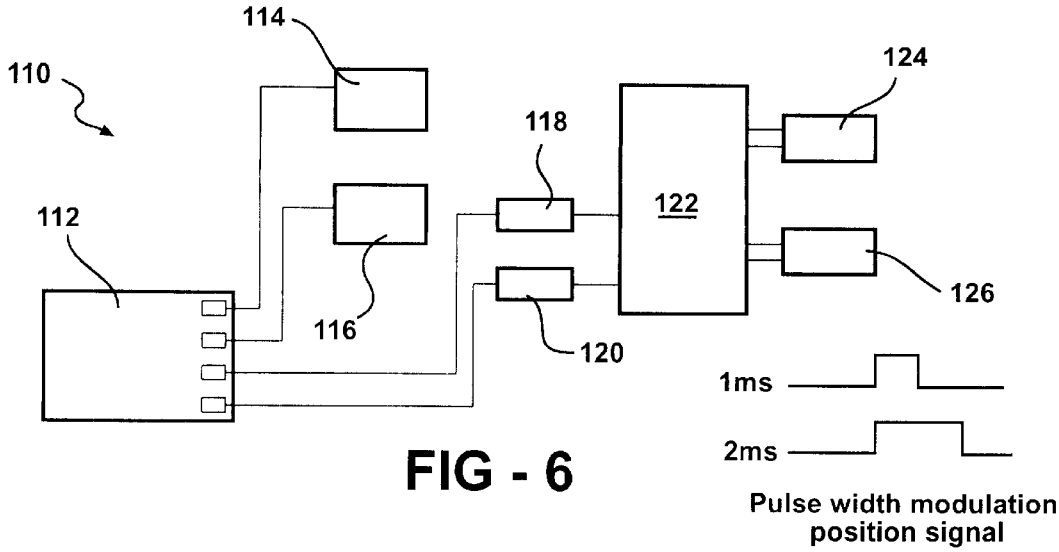
FIG - 6
FIG - 7A
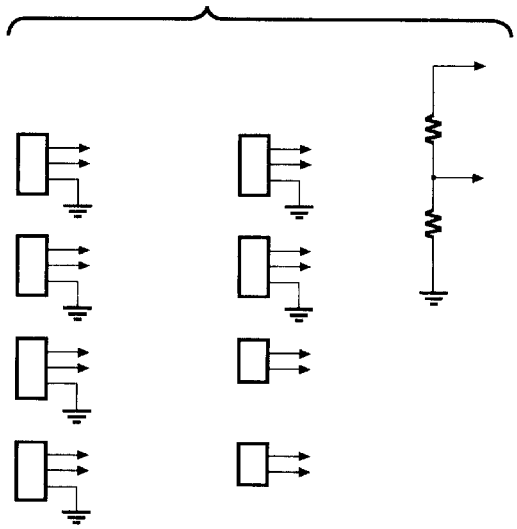
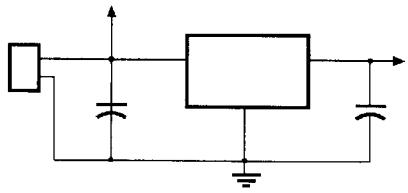
FIG - 7B
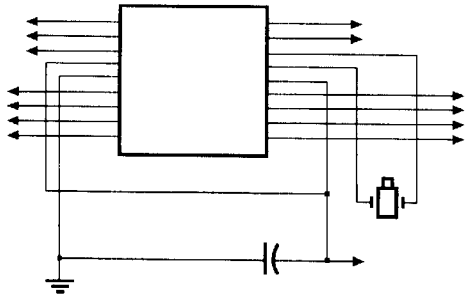
FIG - 7C

ROBOTIC TOY

CROSS REFERENCES TO RELATED APPLICATIONS

This application claims the benefit of U.S. Provisional Application No. 60/181,487 filed on Feb. 10, 2000.

COMPUTER PROGRAM LISTING

A CD-ROM containing a computer program listing appendix has been submitted and is herein incorporated by reference. The CD-ROM contains a single ASII text file named "buy D", created on Feb. 19, 2003, 20,2 KB in size.

TECHNICAL FIELD

The present invention relates generally to robotic toys, and more particularly relates to an animatronic, radio-controlled walking robotic toy.

BACKGROUND OF THE INVENTION

While the 1980's were considered the decade of the computer, and the 1990's were the decade of the internet, it has been predicted that the first decade of the new millennium will be the decade of robots. Robots are being used to mow lawns, vacuum clean houses, deliver mail and other inter office communications in large corporations, as well as many other uses. Of course, robotics and automated manufacturing systems have been in place for decades as their cost became justified. However, robots for everyday entertainment and home consumption have generally been too expensive.

Regardless of their cost, however, the Sony robotic dog, priced at approximately $2,000, has received more orders than Sony Corporation can manufacture. As these are times of great personal wealth, the children of the wealthy individuals have toys available to them, such as the Sony dog, which are unaffordable for most middle-class families. Furthermore, general interest in toy robots is at an all time high, as indicated by the television show "Battlebots" which is listed as a "sport" on the Comedy Central cable television channel. Radio-controlled toys, including airplanes, trains, cars and the like, are more popular than ever. Hobby shops are being frequented not only by children, but by adults looking for entertainment. Parents would love to buy "Little Johnnie" a nice radio-controlled robot toy for Christmas, but it has been too expensive.

Consequently, there is a market for a radio-controlled robotic toy which is less expensive than the Sony dog and more on the order of a radio-controlled car or airplane. There has been a long felt need for a moderately priced robotic toy for children in middle-income families. It would be advantageous for this robotic toy to be nearly indestructible, as well as being able to receive various outer body shells which can change the appearance of the robot without having to change the motor-driven body or its electronics.

Therefore, it is an object of the present invention to provide an inexpensive, effective, durable robotic toy which is useful in these arts.

It is also an object of the present invention to provide a robotic toy which is adapted for receiving various outer body shells to portray various insects, animals, winged demons, dinosaurs, and the like.

SUMMARY OF THE INVENTION

Therefore, in accordance with the objects and advantages listed above, and in achieving those objects, the present invention discloses a walking robotic toy which includes a radio-controlled electrically driven motor within a chassis, a transmission therein coupled to a drive wheel assembly, and at least two motor-driven middle legs and at least two pivotal corner legs, both being attached to drive mechanisms. In one of the preferred embodiments, a robotic head is also included, said head having at least one servo motor attached to a gear assembly for activating movable components, such as teeth clenching, jaw pinching, head up-and-down movement, and head side-to-side movement. Further, in the preferred embodiment, the invention includes a six-legged walking animatronic toy, powered by a rechargeable battery, and controlled via a radio-controlled transmitter and receiver pair.

Interchangeable outer body shells depicting various animals and insects may be clipped or easily attached to the top of the robot toy chassis. These shells may be made of rigid plastic materials, or of soft rubber-like materials for depicting various animals, including dinosaurs and the like. Furthermore, the shell may be a three-dimensionally blow-molded material having hard and soft portions for attachment and movement, wherein the hard portions may be attached to the chassis, while the soft portions may receive and cover mechanical components for depicting, for example, a dinosaur with a long neck. The servo motors attached to the legs to engage and cause movement are controlled by a standard transmitter/receiver pair interfaced with control electronics. The servo interface from the receiver includes inputs to a printed circuit board for controlling the individual motors attached to the various legs. A printed circuit board receives input information from the first and second servo motors, and controls individual movements via pulse width modulation position signals. Through this mechanism, the control electronics decode the servo signals and generate proportional direction control for the individual motors in communication with the various legs.

Computer software for the motor control input is disclosed in detail further herein below. Servo control and parameters can be mixed for all four quadrants through the computer software. Software for controlling the individual leg movements on both port and starboard sides of the chassis are further described.

Therefore, in accordance with the present invention, an inexpensive, effective and durable robotic toy has been disclosed and claimed which meets or exceeds all of the objects and advantages desired as detailed above.

While the invention has been described herein above, the preferred embodiments and best mode of the invention are described below with reference to the appended drawings and disclosure. The following is a brief description of the drawings and a detailed description of the preferred embodiment.

BRIEF DESCRIPTION OF THE DRAWINGS

FIG. 6 is a block diagram of the transmitter/receiver control board configuration;

FIG. 7A is a schematic diagram of the microcontrol unit for the animatron electronics;

FIG. 7B is a schematic diagram of the voltage regulator configuration;

FIG. 7C is a schematic diagram of the leg drive motor;

DESCRIPTION OF THE PREFERRED EMBODIMENTS

Figure 1:
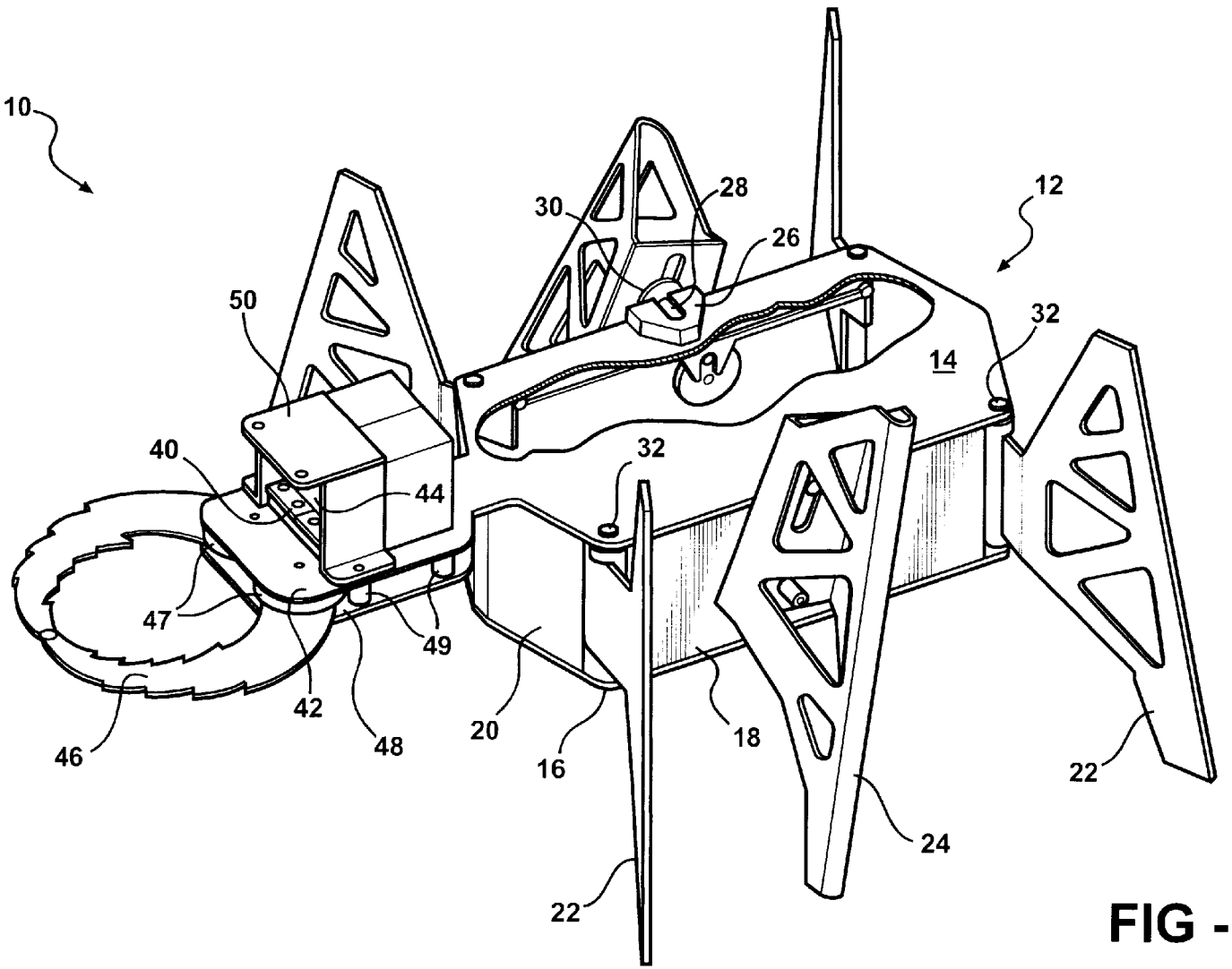
FIG. 1. is a perspective view of a preferred embodiment in accordance with the present invention without its outer body shell.

In accordance with the present invention, a preferred embodiment is shown in FIG. 1 as an animatronic toy generally denoted by the numeral 10 is shown including a main robot body chassis 12, including a top plate 14, a bottom plate 16, side plates 18 on either side, and front and back walls 20 having a substantially longitudinal axis. Attached thereto in a pivotal and/or rotating fashion are corner legs 22 and middle legs 24. Middle legs 24 are attached to robot body chassis 12 by a doubler 26, including a standoff 28 engaged to a drive wheel, as disclosed in greater detail further herein below. An optional backbone, or middle plate, may be secured through the middle of the chassis 12. Although a six-legged walking robot is illustrated, it must be understood that the most basic component of the animatronic toy of the present invention includes robot body chassis 12 and at least two corner legs and at least two middle legs. Furthermore, a single corner leg can be removed as well. One of ordinary skill in the art could remove or add additional legs without undue experimentation.

Looking still to FIG. 1, robot body chassis 12 includes indented portions for receiving upwardly extending alignment notches in the sidewalls 18. Although any securement means which is suitable will work, the preferred method includes using a methylmethacrylate-based epoxy or other adhesive for securing the top and bottom plates 14 and 16, respectively, to side plates and front and rear plates 18 and 20, respectively. The upwardly extending alignment tabs on side plates 18 and front and rear plates 20 fit snuggly into the alignment indentations of the top plate 14. As one can imagine, the final plate securement is done after the pivot extensions 32 are in place so as to hold the pivots for pivoting by top and bottom plates 14 and 16, respectively. Side plate 18 includes a side plate extension 30 also fitting into an alignment indentation at the center of the sides of top plate 14. A motor, not shown in this illustration, is mounted within the robot body chassis 12 as described in further detail with reference to FIGS. 3A–3D.

Looking again to FIG. 1, there is also shown a head portion attached to top plate 14, including a top head plate 42, head bottom plate 48, the two being separated by standoffs 49. The height of standoffs 49 is calculated to accommodate jaws 46 and jaw driver wheels 47. The servo motor 44 is attached to top plate 42 by servo mounting block 40. Servo motor 44 is in communication with jaw driver wheels 47 and creates an in-and-out motion when the drive wheel is moved back and forth by servo motor 44. Optional eyes may be attached to the head by eye mount bracket 50. An additional servo motor may be included for movement of the head of the robotic toy. As can be imagined, further servo motors may be included for up and down movement, and for other desired movements. These servos can receive information and direction in the same manner as the other servo motors.

Figure 2:
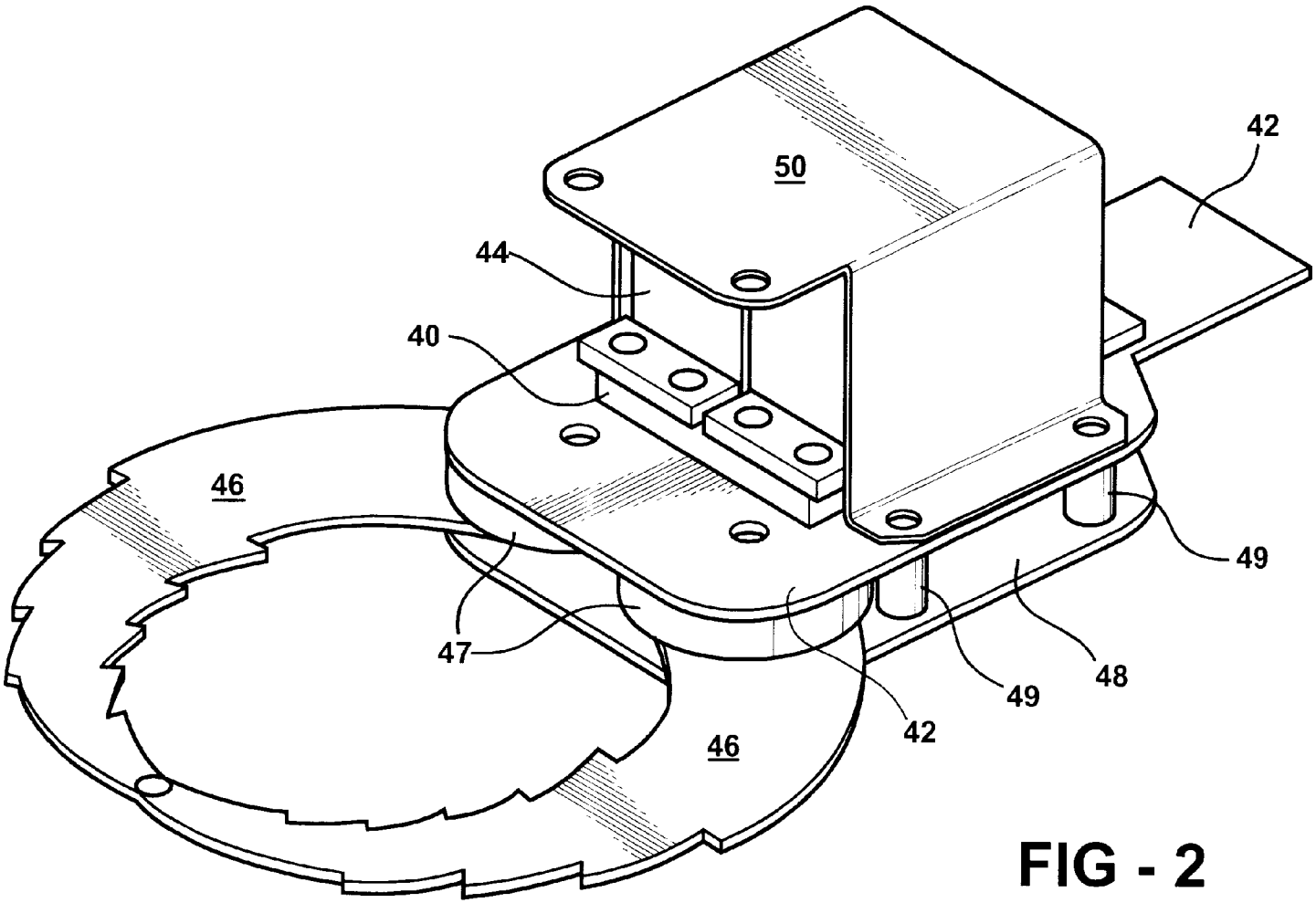
FIG. 2 is a perspective detail of the head portion of the preferred embodiment.

Looking next to FIG. 2, a more detailed illustration of the robot head is shown, with a servo motor 44 for moving jaw pincers 46. Head top plate 42 and head bottom plate 48 are spaced apart by standoffs 49, which has a height adapted for receiving jaw pincers 46 and jaw driver wheels 47 therebetween. Servo 44 is in electrical communication with the electronic control board as described later herein below. When activated by a radio-controlled signal, servo 44 moves its jaw driver wheels 47 which is in communication with jaw pincer 46, thereby moving jaws in and out. Jaw servo 44 may either be a single servo, or potentially may be multiple servos depending upon the actions which are desired. Eye mount bracket 50 acts as a housing for the servo, and is adapted to be attached to top head plate 42 while simultaneously securing standoffs 49 and bottom head plate 48. As can be seen in FIG. 1, the top head plate 42 has an extension which can be secured to the bottom of top body plate 14.

Figure 3A:
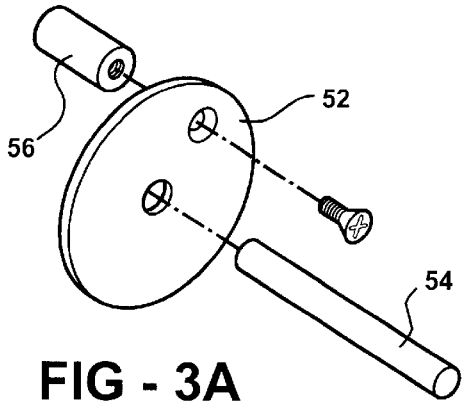
FIG. 3A is an isometric exploded view of the drive wheel assembly.
Figure 3B:
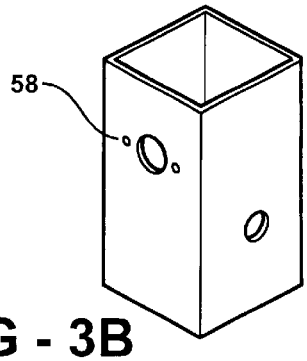
FIG. 3B is an isometric view of the transmission housing of the present invention.
Figure 3C:
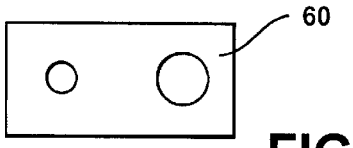
FIG. 3C is a top plan view of a drive arm.

Looking next to FIGS. 3A through 3D, portions of the drive mechanism are illustrated and will be discussed. FIG. 3A illustrates the drive wheel 52 and drive shaft 54 with relative placement of standoff 56. After assembly, the drive wheel assembly of FIG. 3A is fit through the openings in the transmission housing 58 shown in FIG. 3B. As it is fit through one of the holes in the transmission housing 58, drive shaft 54 is press fit onto a diametral pitch worm-drive gear (not shown) with a bore and a hub. Once the press fit is complete, and drive shaft 54 extends out the opposite side of transmission housing 58, it is attached to a drive arm 60 as shown in FIG. 3C. Drive arm 60 is press fit onto drive shaft 54, taking care that the dihedral angle is 0°, substantially in phase, as defined from the hole through the drive arm 60, across drive shaft 54, and into standoff 28. This guarantees the proper alignment of the legs before operation.

Figure 3D:
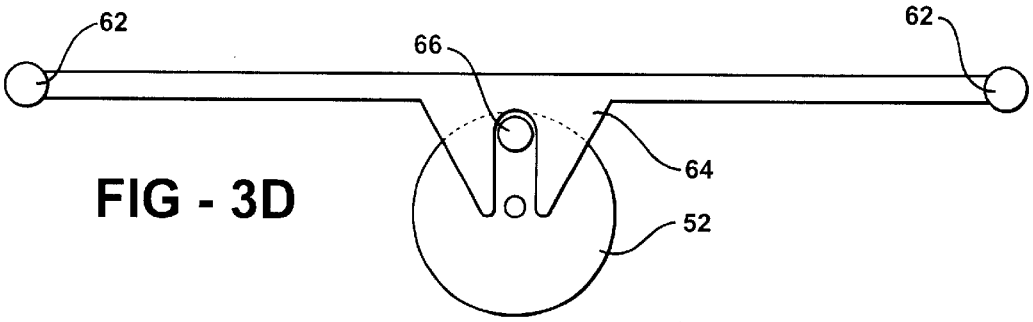
FIG. 3D is a front elevational view of the fore-aft linkage between the drive gear and the corner legs.

Another embodiment of the present invention is shown in FIG. 3D, wherein the fore-aft linkage 64 has a different configuration between the drive gear and corner legs 22. In this diagram, as pivot 66 on drive wheel 52 goes around, it moves the fore-aft linkage 64 from side-to-side, which moves corner legs 22 in proper phase with middle leg 24. Depending upon the application, the worm-drive gear may be preferably a 0.833" diameter 48 diametral pitch worm gear drive, having a 0.188" bore, or a 50:1 worm gear drive or a conventional spur gear drive train.

Although many small electric motors available at hobby shops across the country are suitable, the preferred motor was purchased from Sun Motor Industries, Ltd., of 106 King Fuk Street, San Po Kong, KLN, Hong Kong. The motor type is a small PMDC motor, with a 7.2 voltage DC constant rated voltage between motor terminals. The direction of rotation is counter-clockwise when viewed from the output shaft side of the motor. With such a motor, a small bushing may be press fit onto the motor shaft. Spacers, preferably about 5/1,000 thick, may be threaded onto the shaft of the motor to separate the motor housing from the shaft bushing. Thereafter, a worm-drive gear may be press fit onto the bushing. The motor assembly may then be attached to the transmission housing with pan head screws, inserted through the holes from the inside of the transmission housing. Once completed, the motor can be attached to the outside of the transmission housing with the worm and drive gears engaging. With the transmission being complete, and when power is supplied to the motor, the drive shaft spins about its axis and drives the standoff 28 and drive arm 54.

Figure 4A:
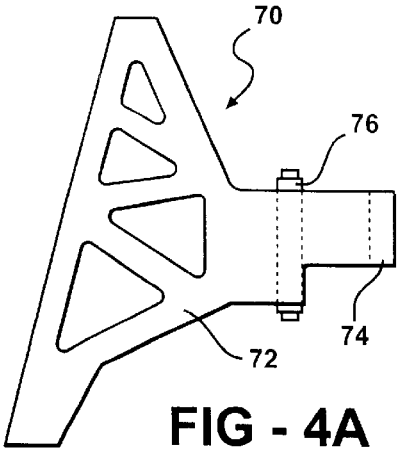
FIG. 4A is a side elevational view of a corner leg.
Figure 4B:
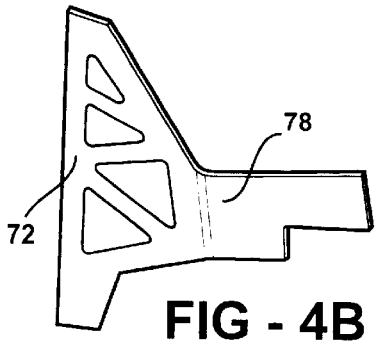
FIG. 4B is a perspective view of a corner leg.
Figure 4C:
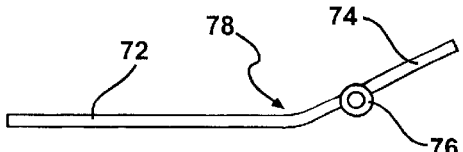
FIG. 4C is a top view of the corner leg of FIG. 4A, showing the bend of the leg.

Referring now to FIGS. 4A through 4C, there is shown an example of a corner leg such as corner leg 22 of FIG. 1. A corner leg in accordance with the present invention is generally denoted by numeral 70, and includes structural member 72, pivot doubler 74, and pivot 76. Like numerals will refer to like elements in FIGS. 4A–4C. In FIGS. 4B and 4C, the bend 78 of corner leg 70 can be seen. Although corner leg 70 may not incorporate a bend, such a bend adds to the stability and walking capability of the animatronic toy of the present invention. Referring back to FIG. 1, it can be seen that corner legs 22 are bent outwardly in a radial fashion from the center of the robot body chassis 12, adding stability and functionality.

Figure 4D:
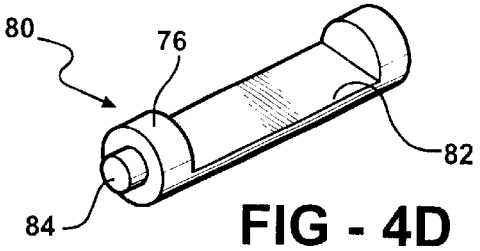
FIG. 4D is a perspective view of the notched pivot for use with a corner leg.

Looking to FIG. 4D, the pivot generally denoted by numeral 80 is shown with a pivot notch 82 and a pivot extension 84. Pivot notch 82 is formed in pivot 80 to be received by and secured to corner leg 70 as illustrated in FIG. 4A. Pivot extension 76 of FIG. 4A is shown having pivot extension 84 extending upwardly and downwardly therefrom. The radius of pivot extension 84 is smaller than the rest of pivot 76 so as to be received in pivot receptor holes 32 of top plate 14 and bottom plate 16 (not shown). The ball joint ends 62 of FIG. 3D are attached to the pivot doubler 74 of corner leg 70 and driven via drive wheel 52.

Figure 5C:
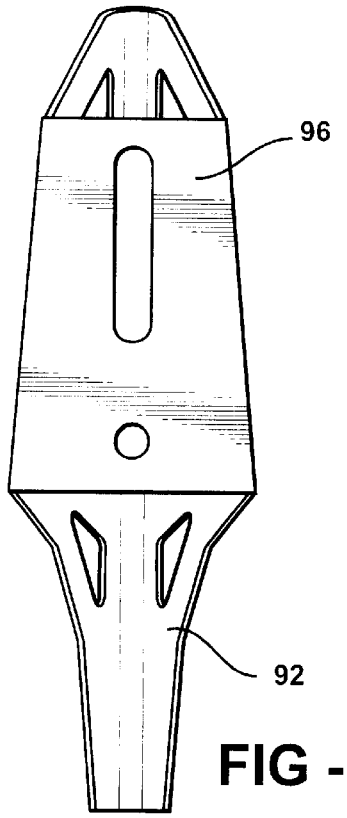
FIG. 5C shows the relative placement of the middle leg base plate when attached to the middle leg.
Figure 5A:
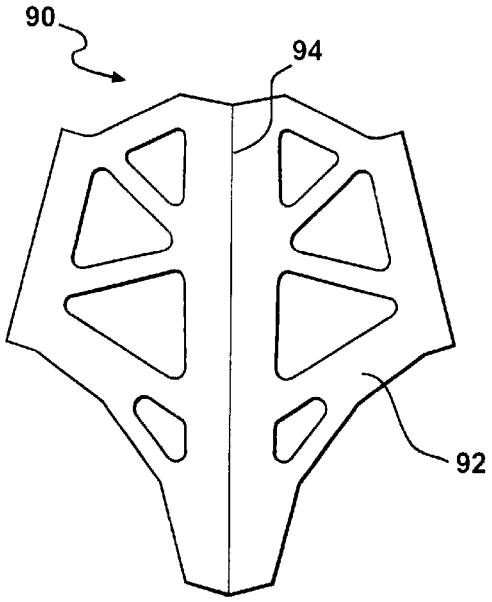
FIG. 5A is a top plan view of the unbent middle leg.
Figure 5B:
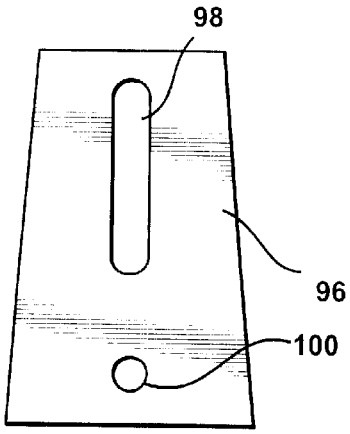
FIG. 5B is the middle leg base plate before attachment to the middle leg.
Figure 5D:
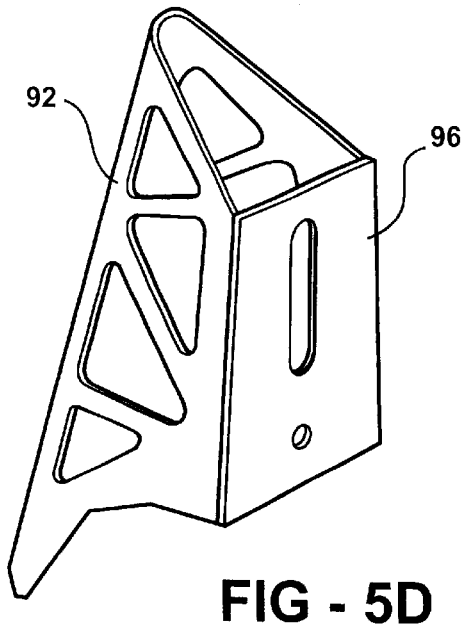
FIG. 5D is a perspective view of the assembled middle leg.

Looking next to FIGS. 5A through 5D, there is shown a middle leg in accordance with the present invention generally denoted by the numeral 90, including structural outer shell members 92 and a bend line 94. Middle leg base plate 96 is illustrated in FIG. 5B showing standoff receptor slot 98 and middle leg securement receptor 100. When assembling together the middle leg base plate of FIG. 5B and the middle leg of FIG. 5A, the device of FIG. 5C results with base plate 96 and structural outer shell members 92 being illustrated. FIG. 5D is a perspective view of middle leg 92 with base plate .96 attached thereto. Reviewing now FIG. 1 in the context of FIGS. 5A–5D, the middle leg is shown as attached to side plate upper extension 30, through standoff 28 and secured by doubler 26.

In FIG. 6, the transmitter/receiver control board configuration is shown as a block diagram wherein the control board is generally denoted by the numeral 110, and includes a receiver 112 having four outputs, although any number of outputs are possible, and more or less are also envisioned by the inventors. In the event that there are additional servo motors for more or additional body parts, or directional movement needed, additional outputs would be required. Although there is a limit to the number of signals which can be generated by an off the shelf radio controlled transmitter, 10 channel transmitters are easy to purchase, and could be used for up/down head movement, side-to-side head/body/tail movements, depending upon the number of moving parts in the animatronic robot toy. In the event of a dinosaur animatron, there may be up/down and side/side movements of the head as well as independent neck and tail movements desired, for instance a brontosaurus or the like. Any type of insect, animal or robot is envisioned by the present invention. These possible animatrons may have fingers, toes, grippers, or any other moving parts which will require a servo motor to be activated by a channel on the transmitter. The addition of more inputs in the electronics of the present invention is known in the art and can be managed without undue experimentation.

In the preferred embodiment insect animatronic toy shown here in FIGS. 1–6, there is included a jaw servo 114 and a head servo 116 which receive their inputs from receiver outputs 1 and 2. Leg drive motors 1 and 2 are controlled via the servo motor #1 input 118 and servo motor #2 input 120 through printed circuit board 122. Leg drive motor #1 124 is in electrical communication with one of the middle legs, as well as the corner legs via the fore-aft linkage as shown earlier. Likewise, leg drive motor #2 126 operates the opposite side of the robotic toy middle leg, in conjunction with the corner legs also via a fore-aft linkage as described above.

Figure 7D:
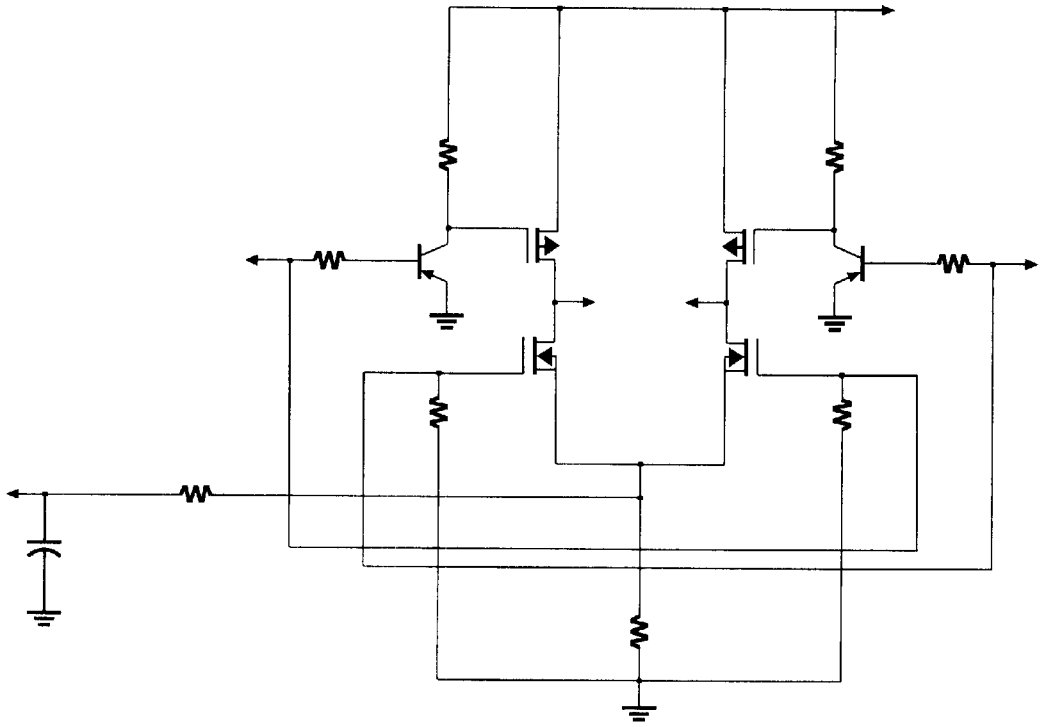
FIG. 7D is a schematic diagram of an H-bridge driver circuit.
Figure 7E:
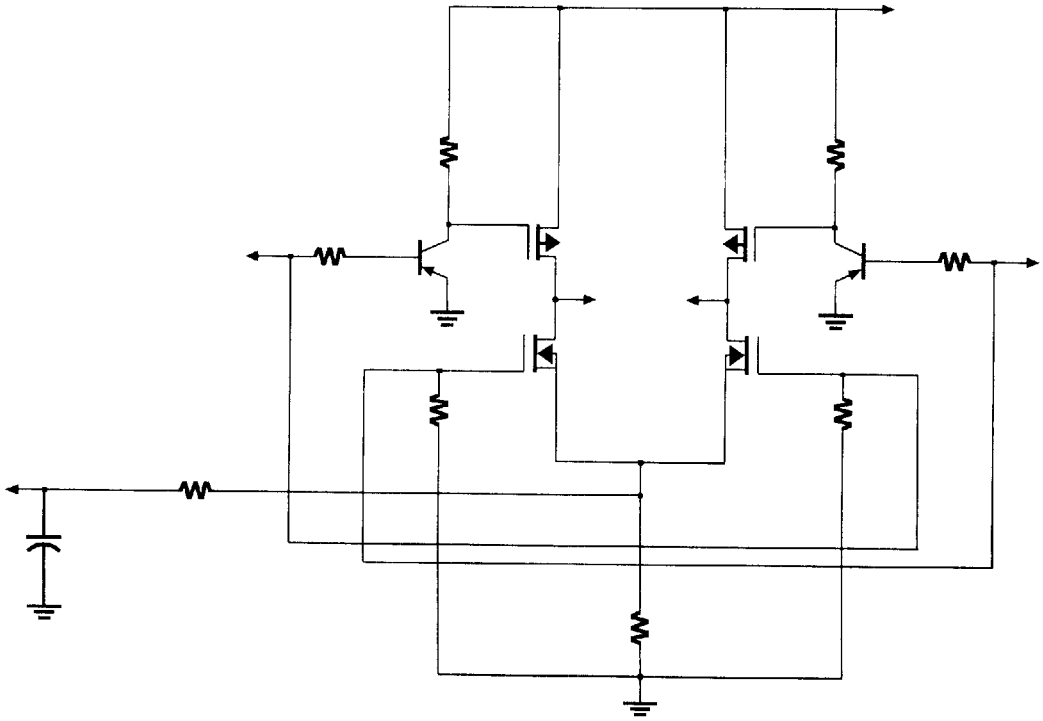
FIG. 7E is a schematic diagram of another H-bridge driver circuit.

FIGS. 7A through 7E illustrate the schematic diagram for the electronics. Included are the microcontrol unit of FIG. 7A, the voltage regulator of FIG. 7B and the microprocessor as shown in FIG. 7C, as well the H-bridge driver circuits of FIGS. 7D and 7E which control the middle and corner legs of either side of the animatron. The microcontrol unit, voltage regulator, microprocessor and H-bridge driver circuits are standard electronic features selected for their applicability to the present embodiment. Of course, as additional servos would be added to the present invention to yield more animatron body part movements, more of these same controls would be added to make accommodations for those additional servos.

Figure 8A:
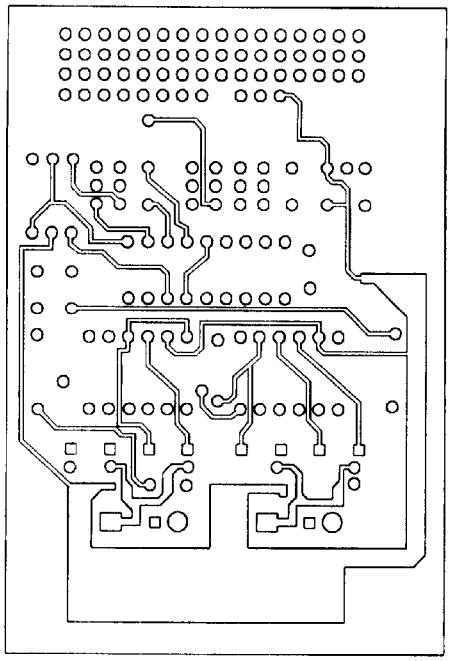
FIG. 8A is an illustration of the top of the printed circuit board showing the electrical connections.
Figure 8B:
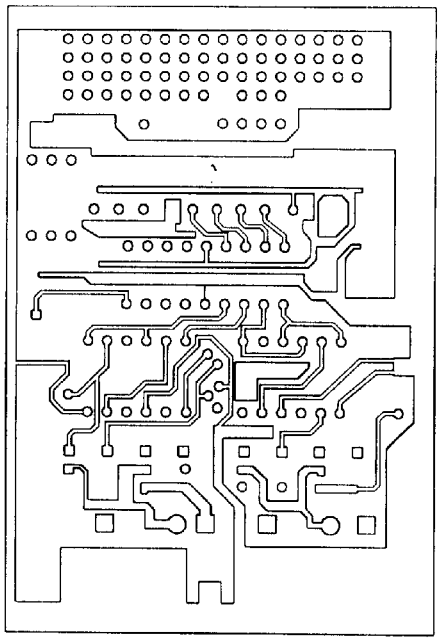
FIG. 8B is an illustration of the bottom of the printed circuit board.
Figure 8C:
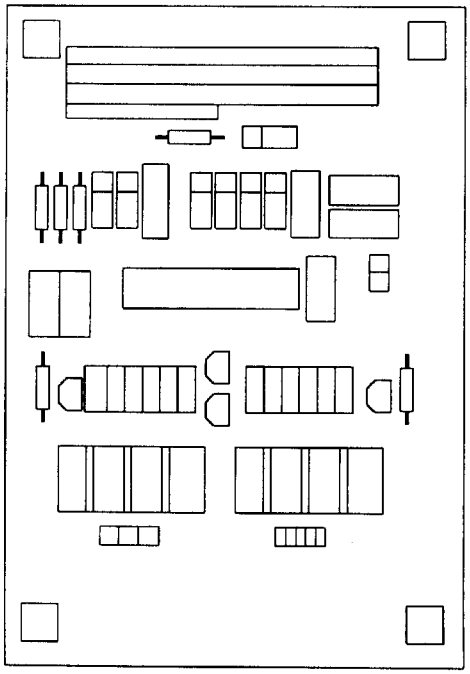
FIG. 8C illustrates the relative placement of the electronic components on the printed circuit board.

FIGS. 8A through 8C illustrate the component layout for the printed circuit board, including an illustration of the printed circuit board top (FIG. 8A) and the layout of the printed circuit board bottom (FIG. 8B). The component layout is illustrated in FIG. 8C and shows the relative placement of all of the resistors, MOSFETs, and all of the other transistor components. To operate the printed circuit board, computer software is employed for regulating the radio-controlled transceiver output into messages to control the servo motors, and thereby control the movements of the animatronic robot toy. The following computer software is illustrative of the software which may be used in order to operate the present invention, although as can be imagined by one of ordinary skill in the art, modifications and alterations can be made while still achieving the same purpose.

Therefore, in accordance with the present invention, there has been disclosed a robotic toy that meets or exceeds the objects and advantages described above. As one of ordinary skill in the art could envision many modifications, alterations and changes which could be made to the present invention, it must be noted that the scope of the claims is not to be limited by the recitation of the preferred embodiments above, but rather by the scope and breadth of the appended claims.

What is claim is:

1. A robotic toy to be operated by a radio-controlled transmitter, comprising:

a main robot body chassis including at least one radio-controlled electric motor mounted in the chassis;

at least two middle legs attached to the main robot body mid-chassis for movement, wherein the middle legs are moved by a drive wheel assembly through a transmission after receiving signals from a radio-controlled transmitter;

at least two corner legs attached elsewhere on the robot body chassis;

a drive gear attached to a drive shaft;

a linkage drive arm in communication with the drive gear extending between one of the at least two middle legs and one of the at least two corner legs on the same side of the body chassis, such that when the electric motor is engaged, the drive wheel assembly translates motion through the drive shaft and the linkage drive arm to the middle legs and corner legs on either side;

control electronics for receiving output from the radio-controlled transmitter, including a receiver output section and inputs to a printed circuit board, said electronics including a micro-control unit, a voltage regulator, a microprocessor and at least two H-bridge driver circuits for operating at least one of the middle legs attached to the body chassis and at least one of the corner legs attached to the same side of the body chassis; and computer software for operating the control electronics which then controls the movement of the legs attached to the chassis giving movement to the robotic toy.

2. The robotic toy of claim 1, further comprising:

a movable head with servo motors to move the head side to side and up and down, in addition to jaw pincers which can move in and out in response to servo motor communication with the control electronics which also further includes driver circuits for each of the servo motors.

3. The robotic toy of claim 1, further comprising:

at least six legs attached to the main robot body chassis, wherein at least two of the legs are middle legs which are moved by the drive wheel assembly through the transmission after receiving signals from the radio-controlled transmitter.

4. The robotic toy of claim 1, wherein the drive wheel assembly includes an electric motor and a 48 diametral pitch worm drive gear at a 50:1 ratio.

5. The robotic toy of claim 1, wherein the drive wheel assembly includes a spur gear drive train.

6. The robotic toy of claim 1, further comprising eyes attached to the head by an eye mount bracket.

7. The robotic toy of claim 1, wherein the toy includes a dinosaur-shaped toy.

8. The robotic toy of claim 1, further comprising a tail section adapted for moving from side to side and up and down.

9. The robotic toy of claim 1, further comprising interchangeable body shell components shaped as various animals, dinosaurs and insects.

10. The robotic toy of claim 1, wherein the legs on one side of the toy operate to move forward, while the legs on the opposite side of the toy remain stationary, thereby propelling the robotic toy forward on one side, followed by a forward motion on the other side.

11. The robotic toy of claim 1, wherein the legs on one side of the toy may propel forward, while the legs on the opposite side of the toy may be in reverse, allowing a spinning action to take place so that the robotic toy is extremely maneuverable.

12. A robotic toy to be operated by a radio-controlled transmitter, further comprising:

a main robot body chassis including at least one radio-controlled electric motor mounted in the chassis;

at least two middle legs attached to the main robot body mid-chassis for movement, wherein the middle legs are moved by a drive wheel assembly through a transmission after receiving signals from a radio-controlled transmitter;

at least two corner legs attached elsewhere on the robot body chassis;

a drive gear attached to a drive shaft;

a linkage drive arm in communication with the drive gear extending between one of the at least two middle legs and one of the at least two corner legs on the same side of the body chassis, such that when the electric motor is engaged, the drive wheel assembly translates motion through the drive shaft and the linkage drive arm to the middle legs and corner legs on either side;

hard wired programs as an output section to the printed circuit board, including a hard wired driver circuit, voltage regulator, and as many circuits as needed for operating the at least one of the middle legs attached to the body chassis and at least one of the corner legs attached to the same side of the body chassis; and computer software for operating the control electronics which then controls the movement of the legs attached to the chassis giving movement to the robotic toy.

13. An animatronic robot toy to be operated by a radio-controlled transmitter, comprising:

a main robot body chassis including a body shell covering the main body chassis, wherein said body shell may be a share selected from the group consisting of insects, robots dinosaurs, rodents, and animals;

at least one radio-controlled electric motor mounted in the chassis;

at least two middle legs attached to the main robot body mid-chassis for movement, wherein the middle legs are moved by a drive wheel assembly through a transmission after receiving signals from a radio-controlled transmitter;

at least two corner legs attached elsewhere on the robot body chassis;

a drive gear attached to a drive shaft; and at least one linkage drive arm in communication with the drive gear extending between one of the at least two middle legs and one of the at least two corner legs on the same side of the body chassis, and another linkage drive arm in similar mechanical communication between the middle and corner legs on the opposite side of the chassis such that when the electric motor is engaged, the drive wheel assembly translates motion through the drive shaft and the linkage drive arm to the middle legs and corner legs on either side.

14. The robotic toy of claim 13, wherein the legs on one side of the toy operate to move forward, while the legs on the opposite side of the toy remain stationary, thereby propelling the robotic toy forward on one side, followed by a forward motion on the other side.

15. The robotic toy of claim 13, wherein the legs on one side of the toy may propel forward, while the legs on the opposite side of the toy may be in reverse, allowing a spinning action to take place so that the robotic toy is extremely maneuverable.

16. The animatronic toy of claim 13, further comprising interchangeable body shells to change the appearance of the toy.

17. The robotic toy of claim 13, wherein the drive wheel assembly includes an electric motor and a 48 diametral pitch worm drive gear at a 50:1 ratio.

18. The robotic toy of claim 13, wherein the drive wheel assembly includes a spur gear drive train.

19. The robotic toy of claim 13, further comprising eyes attached to the head by an eye mount bracket.

20. An insectazoid robotic toy to be operated by a radio-controlled transmitter, comprising:

a main robot body chassis including a body shell covering the main body chassis, wherein said body shell may be a shape selected from the group consisting of insects, robots, dinosaurs, rodents, and animals;

a body shell covering the main body chassis, said body shell being interchangeable and designed to be insect-shaped;

at least one radio-controlled electric motor mounted in the chassis;

at least two middle legs attached to the main robot body mid-chassis for movement, wherein the middle legs are moved by a drive wheel assembly through a transmission after receiving signals from a radio-controlled transmitter;

at least four corner legs attached elsewhere on the robot body chassis;

a drive gear attached to a drive shaft;

at least one linkage drive arm in communication with the drive gear extending between one of the at least two middle legs and one of the at least two corner legs on the same side of the body chassis, and another linkage drive arm in similar mechanical communication between the middle and corner legs on the opposite side of the chassis such that when the electric motor is engaged, the drive wheel assembly translates motion through the drive shaft and the linkage drive arm to the middle legs and corner legs on either side;

control electronics for receiving output from the radio-controlled transmitter, including a receiver output section and inputs to a printed circuit board, said electronics including a micro-control unit, a voltage regulator, a microprocessor and at least two H-bridge driver circuits for operating at least one of the middle legs attached to the body chassis and at least one of the corner legs attached to the same side of the body chassis; and computer software for operating the control electronics which then controls the movement of the legs attached to the chassis giving movement to the robotic toy.

* * * * *